United States Patent [19]

Moss

[11] Patent Number: 4,484,774

[45] Date of Patent: Nov. 27, 1984

[54] BOTTLE CARRIER

[75] Inventor: James F. Moss, Tulsa, Okla.

[73] Assignee: Liberty Glass Company, Sapulpa, Okla.

[21] Appl. No.: 376,676

[22] Filed: May 10, 1982

[51] Int. Cl.[3] ..... B65D 71/00

[52] U.S. Cl. ..... 294/87.2; 206/150; 206/158; 206/199

[58] Field of Search ..... 294/87.2, 87.22, 87.28; 206/150, 158, 139, 145, 147, 148, 151, 159, 161, 162, 199, 201, 427, 430, 433; 215/100 A

[56] References Cited

U.S. PATENT DOCUMENTS 4,235,468 11/1980 Erickson ..... 294/87.2

4,365,835 12/1982 Quelch ..... 294/87.2

*Primary Examiner*—Johnny D. Cherry

*Attorney, Agent, or Firm*—Senniger, Powers, Leavitt and Roedel

[57] ABSTRACT

A molded plastic carrier for six bottles arranged in two side-by-side rows of three each (a "six-pack"), the carrier having a handle portion, three bottle grippers in a row on each side of the handle portion, and a loop for encircling the six bottles supported by struts below the level of the handle portion and grippers, the struts being specially positioned relative to the grippers for automatically centering the carrier on a cluster of six bottles in the initial stage of application of the carrier to the cluster by apparatus for automatically applying the carriers to the six-bottle clusters, to avoid breakage of carriers by the instrumentality of the apparatus which pushes them down on the bottles.

6 Claims, 10 Drawing Figures

BOTTLE CARRIER

BACKGROUND OF THE INVENTION

This invention relates to bottle carriers, and more particularly to molded plastic carriers for bottles such as filled soft drink bottles.

The invention is especially concerned with a topgrip bottle carrier, i.e., a carrier which grips a plurality of bottles, e.g., a cluster of six bottles arranged in two rows of three each (a "six-pack"), by the bottle necks, and is generally in the same class as and involves an improvement upon the bottle carrier with a "loop bar" shown in U.S. Pat. No. 4,235,468 issued Nov. 25, 1980. In general, that bottle carrier has three bottle grippers constituted by collars (10) in a row on each side thereof, the collars being within a frame (11), and a so-called loop bar (12) for encircling the bottles supported by struts (13). Apparatus has been developed for automatically applying carriers similar to the carrier shown in U.S. Pat. No. 4,235,468 to clusters of six bottles, the apparatus being operable automatically to dispense carriers from a supply, place them on clusters, and then push them down for causing them to grip the bottles in the clusters. Such apparatus will operate generally satisfactorily on the aforesaid prior art carriers provided each carrier is initially placed on a six-bottle cluster in what may be referred to as centered relation with respect to the cluster, i.e., with the six bottle grippers of the carrier centered with respect to the six bottles in the cluster, but it happens too frequently that the carrier is not so centered for being pushed down on the bottles in the cluster, and the carriers, as a result, may be broken.

SUMMARY OF THE INVENTION

Among the several objects of the invention may be noted the provision of an improved bottle carrier of the type such as shown in U.S. Pat. No. 4,235,468 having a loop for encircling bottles in a cluster, adapted automatically to center itself on a cluster of bottles as it is applied to the cluster in the operation of machinery such as is presently in use for applying the carriers, thereby to provide for proper application of the carriers to the clusters of bottles avoiding breakage of the carriers; and the provision of such a carrier which is as readily molded as the prior carrier with a loop bar.

A molded plastic bottle carrier of this invention is adapted for gripping a cluster of filled bottles, each of which has a neck, a finish on the neck at the bottle mouth, and a bottle cap, the bottles in the cluster being arranged in two side-by-side rows with the bottles in each row contiguous with respect to one another and with respect to the bottles in the other row. In general, the carrier comprises an elongate handle portion, a first row of bottle grippers at one side and a second row of bottle grippers at the other side of the handle portion, the grippers of the two rows being laterally aligned. A girdle or loop of generally rectangular shape is provided below the handle portion and the grippers, adapted to surround the bottles in the cluster for holding them in close confinement. The loop has sides and ends. Each gripper comprises a split collar for gripping the neck of a bottle under the bottle finish. The collars are spaced on centers corresponding to the spacing of the vertical axes of the bottles in the cluster. A first pair of loop-supporting struts, one at each end of the carrier, extends down from the collars at the ends of the first row generally in the central vertical plane of the first row. A second pair of loop-supporting struts, one at each end of the carrier, extends down from the collars at the ends of the second row generally in the central vertical plane of the second row. Each strut is integrally joined at its upper end to the respective collar at the end of the respective row and angled outward and downward therefrom to an integral juncture with the respective end of the loop. The upper ends of the two struts of each pair are spaced one from the other a distance corresponding to the distance measured in the central vertical plane of a row of bottles from the point on the periphery of the top of the cap of the bottle at one end of the row to the point on the periphery of the top of the cap of the bottle at the other end of the row, whereby when the carrier is placed on a cluster of bottles for being pushed down on the cluster for engagement of each split collar with the neck of a bottle under the bottle finish, the struts act to center the carrier endwise with respect to the cluster.

Other objects and features will be in part apparent and in part pointed out hereinafter.

BRIEF DESCRIPTION OF THE DRAWINGS

FIGS. 5 and 6 show in phantom the carrier pushed down and gripping the bottles.

Corresponding reference characters indicate corresponding parts throughout the several views of the drawings.

DESCRIPTION OF THE PREFERRED EMBODIMENTS

Referring first to FIGS. 1–6, there is generally indicated at 1 a first embodiment of the improved bottle carrier of this invention which is adapted for automatic application to clusters C of bottles B by means of presently available machinery for applying the aforesaid prior art carriers. As shown, the carrier generally comprises a relatively flat elongate central handle portion 3 having three bottle grippers each designated 5 at each side, each adapted to grip the neck of a bottle in a cluster of six bottles arranged in two side-by-side rows of three bottles each, with a girdle or loop 7 below the handle portion and the grippers adapted to surround the bottles in the cluster for holding them in close confinement with the bottles in each row contiguous with respect to one another (see FIG. 5) and with respect to the bottles in the other row (see FIG. 6).

Figure 1:
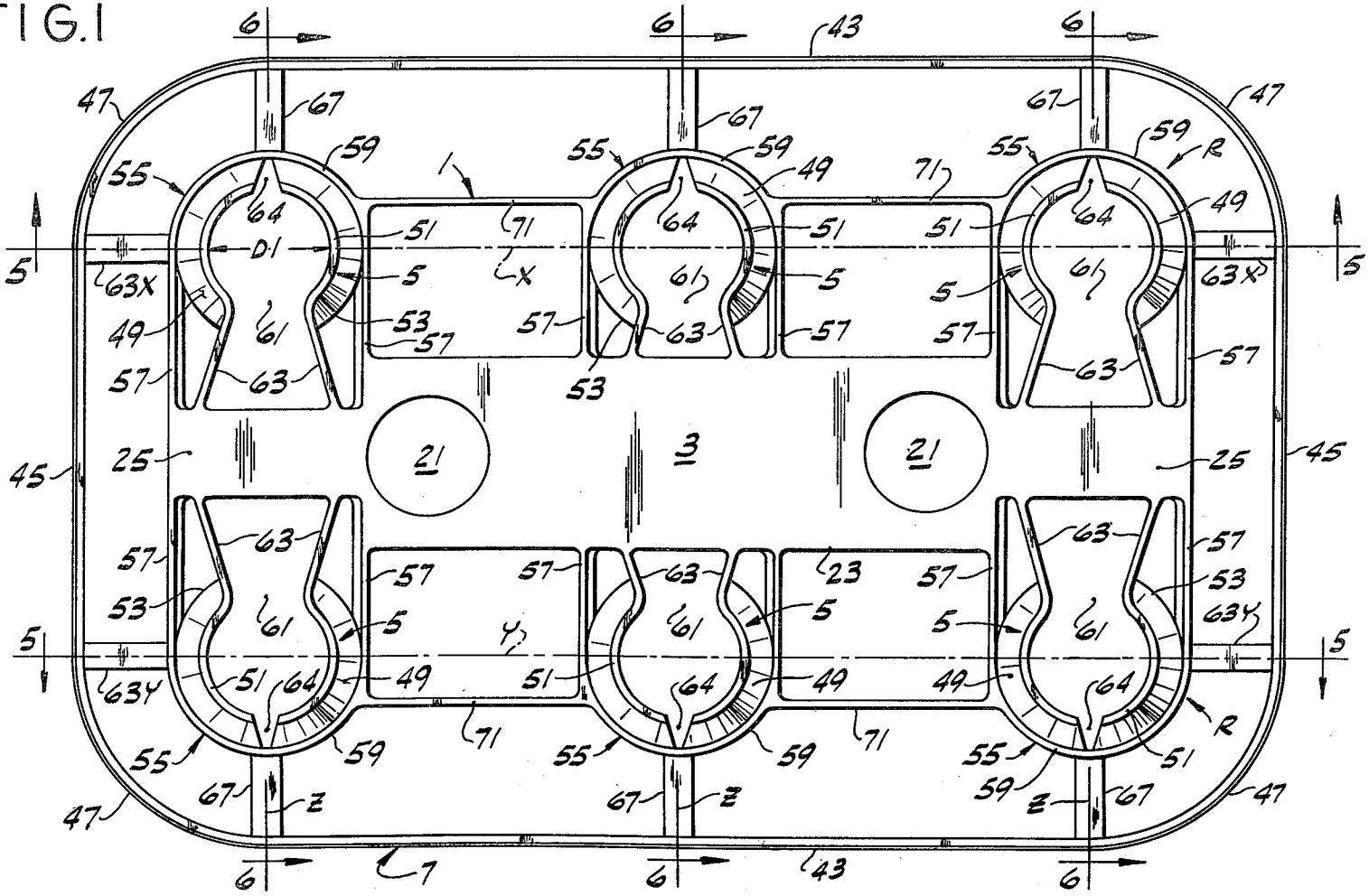
FIG. 1 is a top plan of a molded plastic bottle carrier of this invention.
Figure 2:
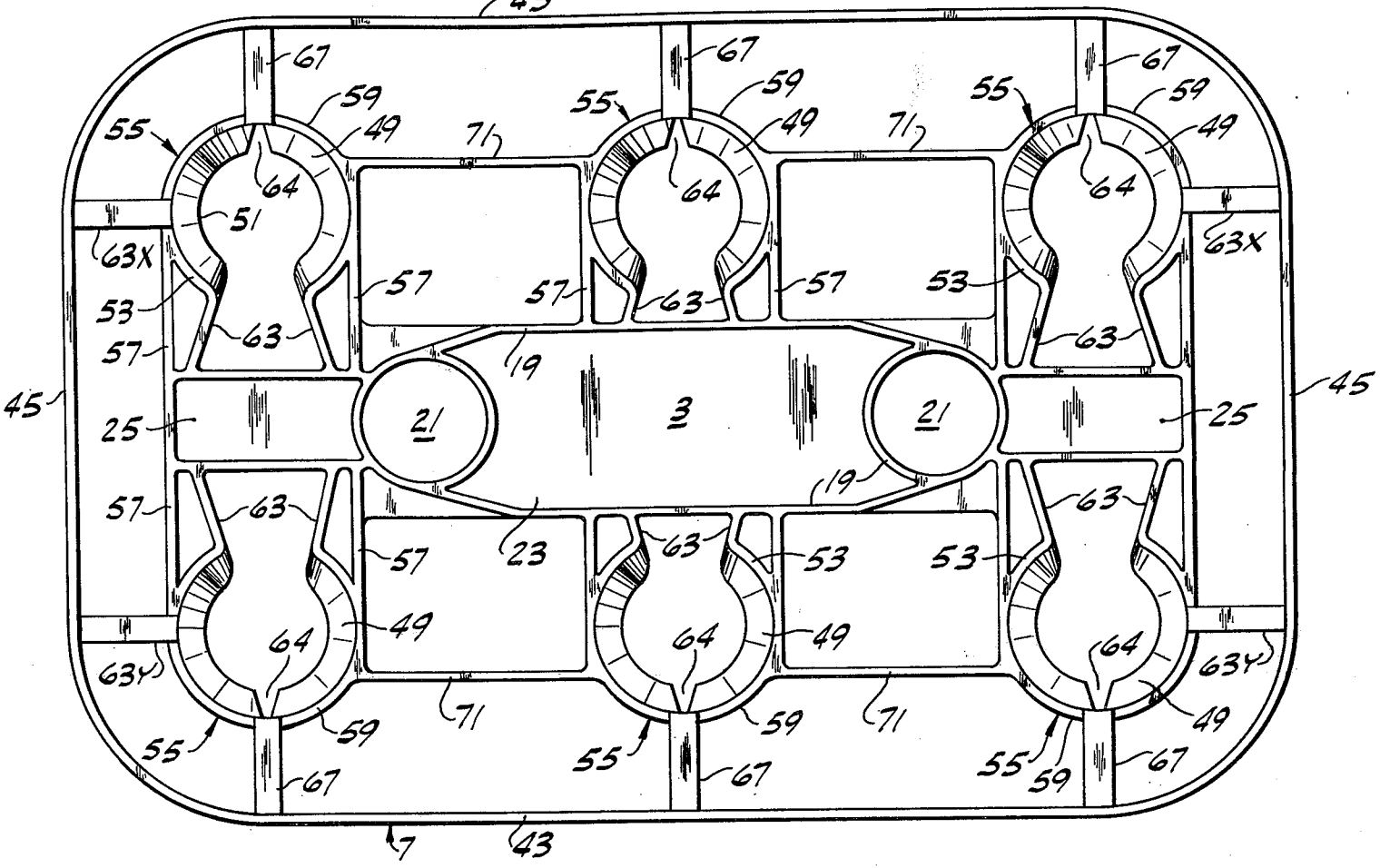
FIG. 2 is a bottom plan of the carrier shown in FIG. 1.
Figure 3:
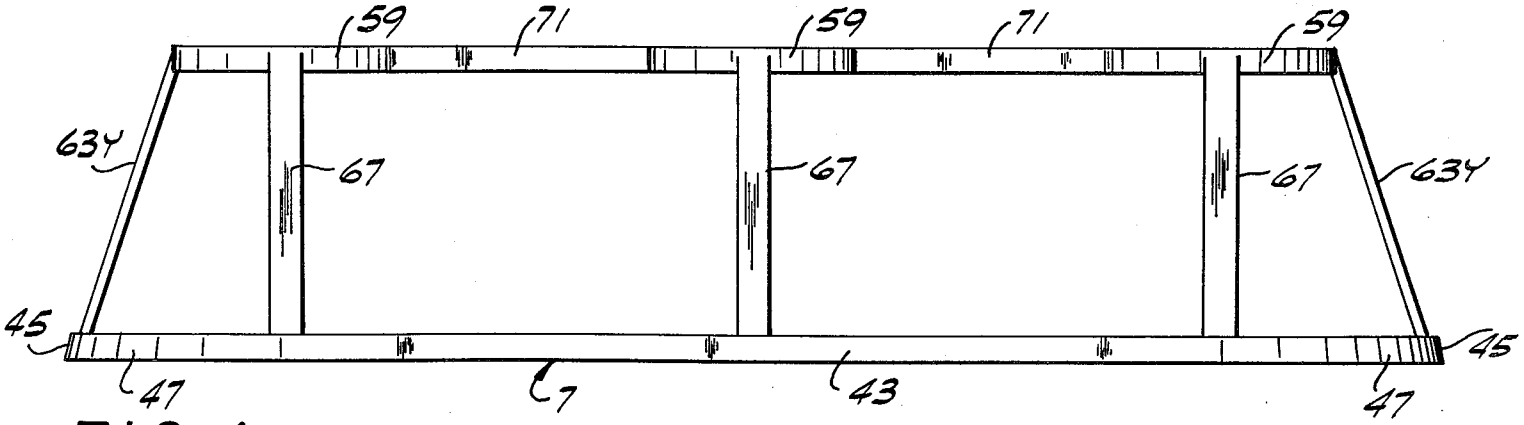
FIG. 3 is a side elevation of the FIG. 1 carrier (both sides being the same)
Figure 4:
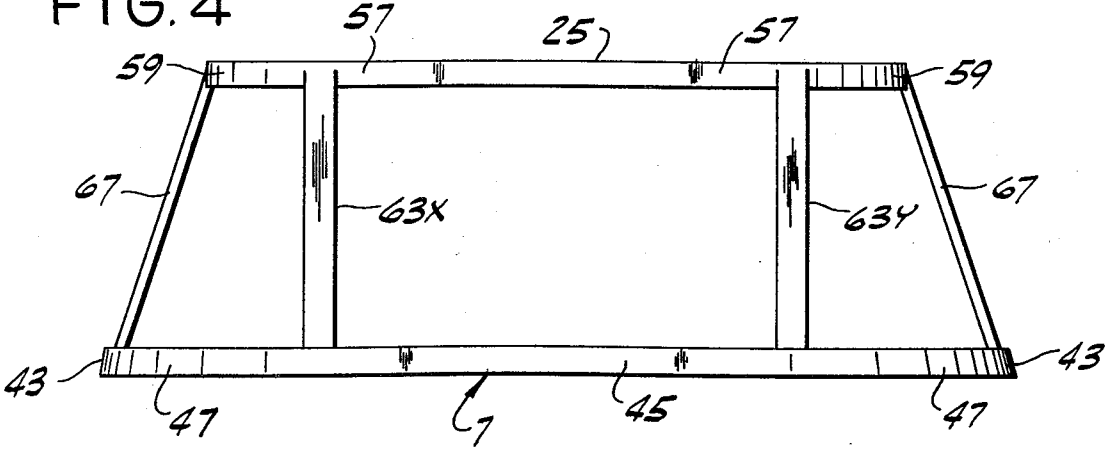
FIG. 4 is an end elevation of the FIG. 1 carrier (both ends being the same)
Figure 5:
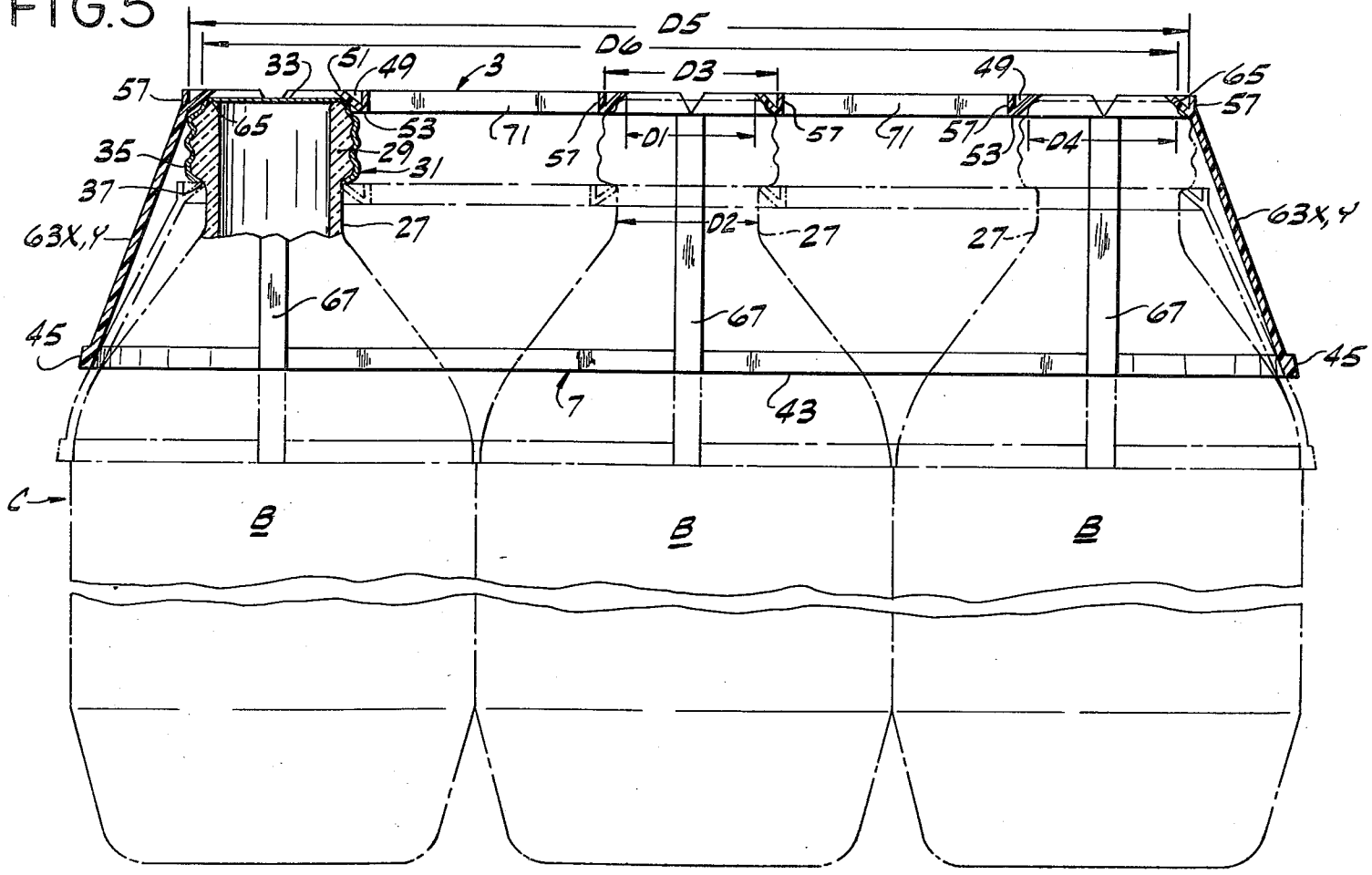
FIG. 5 is a longitudinal section on either of the lines 5—5 shown in FIG. 1 showing how the carrier centers itself endwise on a cluster of bottles for being pushed down on the cluster.
Figure 6:
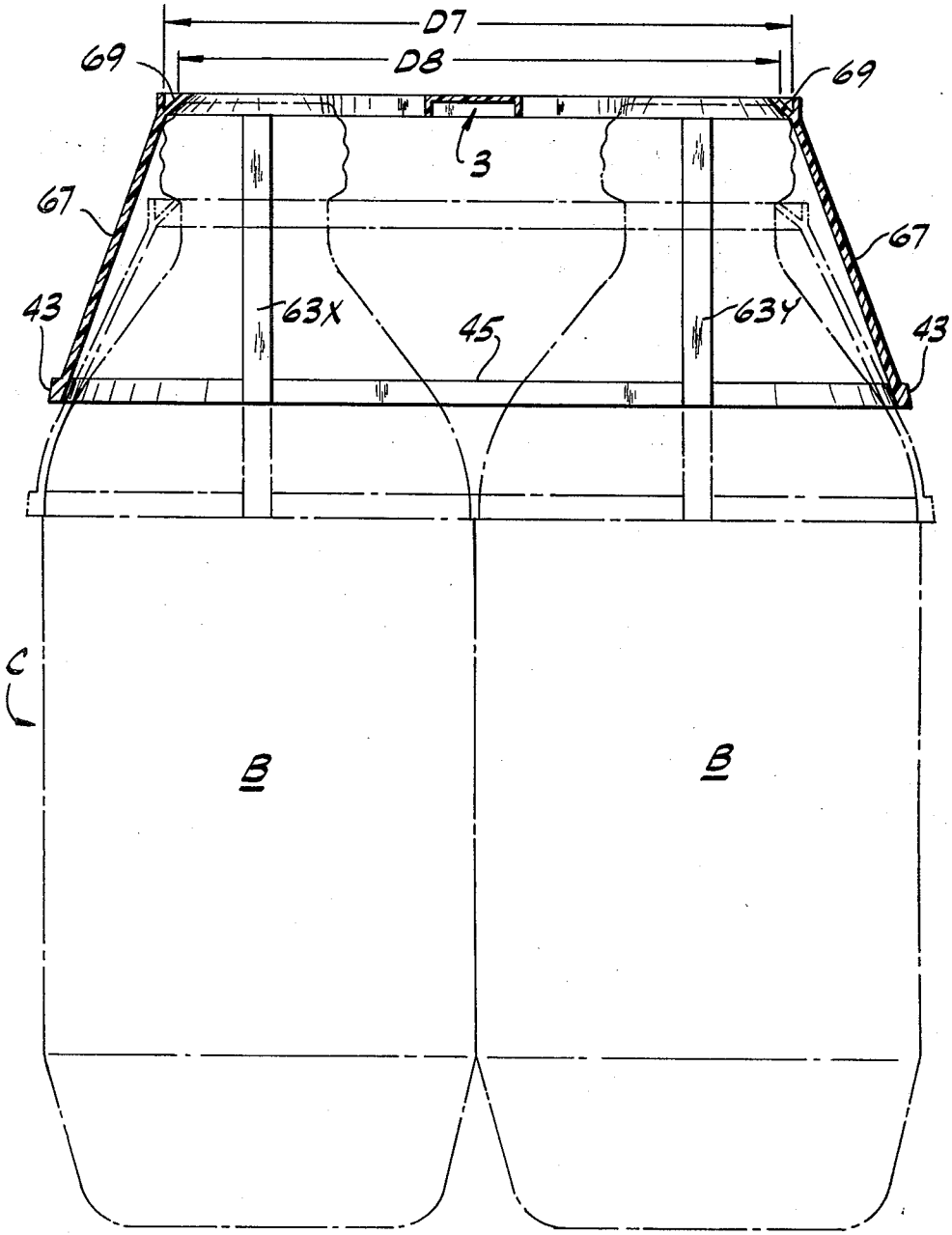
FIG. 6 is a transverse section on any one of the lines 6—6 shown in FIG. 1 showing how the carrier centers itself transversely on a cluster of bottles.
Figure 7:
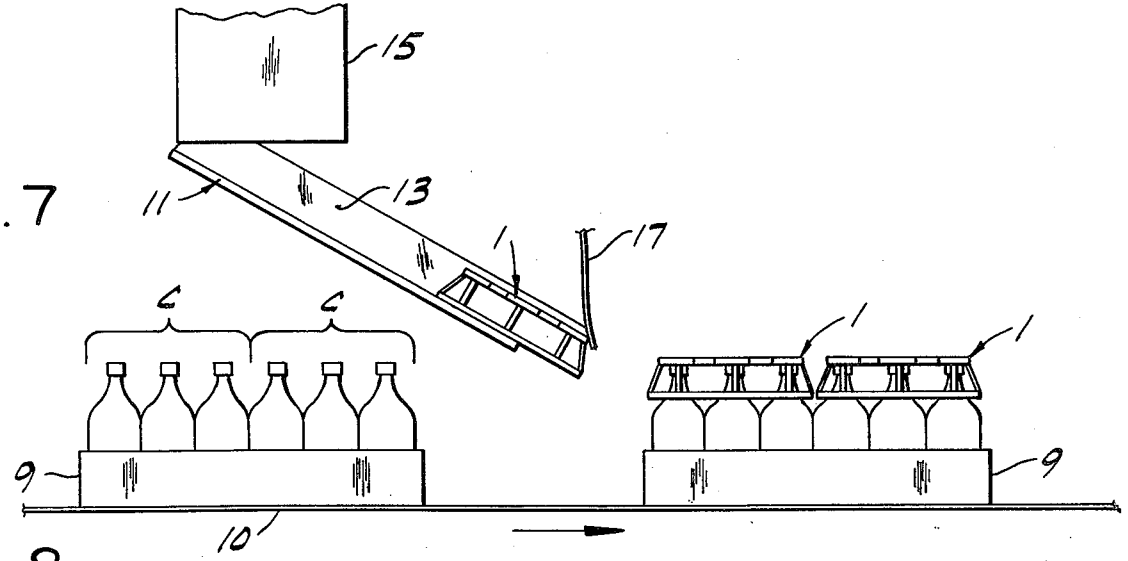
FIG. 7 is a generally diagrammatic side elevation of apparatus for placing the carriers on bottle clusters.
Figure 8:
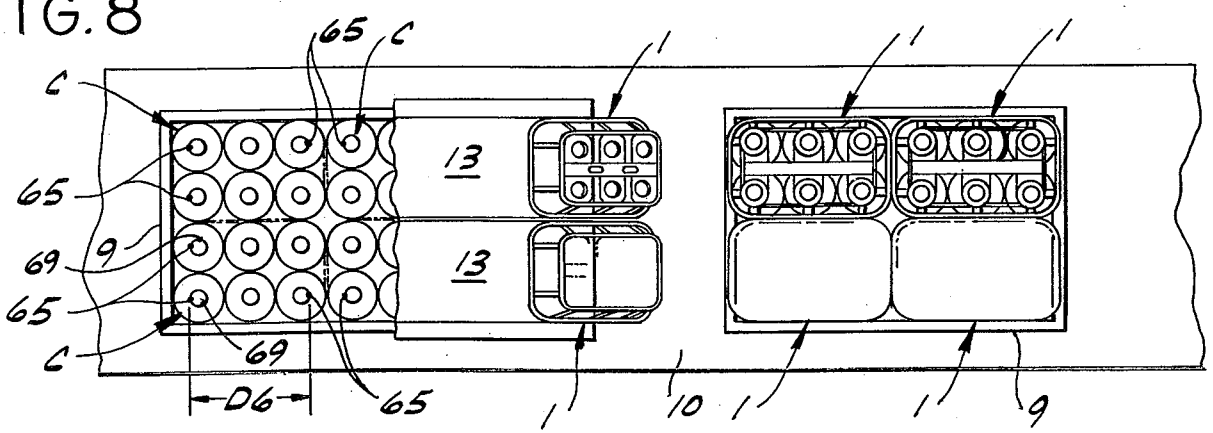
FIG. 8 is a plan of FIG. 7.

As thus broadly described, the carrier corresponds to carriers generally of the type shown in U.S. Pat. No. 4,235,468, which have been manufactured and sold for some time by the assignee of this invention under license. Machinery has been developed for automatically applying such carriers to bottle clusters, this machinery being adapted automatically to place carriers on bottle clusters as more or less diagrammatically shown in FIGS. 7 and 8 for subsequently being pushed down to force the bottle grippers down around the bottle caps to grip the bottles by their necks under the bottle finish. In the operation of this machinery, cases 9 holding twenty-four bottles in a four by six arrangement (rows of six lengthwise, rows of four crosswise) are fed forward one after another on a conveyor 10 in the lengthwise direction of the cases (i.e., in the direction of the four rows of six bottles each) under a dual chute structure 11 comprising two side-by-side inclined chutes each designated 13. Carrier magazines such as indicated in phantom at 15 in FIG. 7 located side-by-side above the upper ends of the two chutes are adapted for the dispensing of carriers down onto the chutes, each carrier sliding down its respective chutes to a pick-off position as illustrated in FIGS. 7 and 8, wherein it is temporarily held by a stop (e.g., a yielding stop) such as diagrammatically indicated at 17 in position for entry of the tops of the leading bottles of a respective cluster of six bottles in a case as the case of twenty-four bottles moves forward and for engagement of the bottle tops with the downstream end of the loop 7 of the carrier. Thus, as the case moves forward, the leading bottles of the two leading clusters in the case engage the downstream ends of the loops 7 of the two carriers and push these carriers off the chute, the carriers then dropping down on these two clusters. Then, two more carriers come down the chutes and are similarly picked off by the two trailing clusters of the case. Farther down the line, each carrier is pushed down on the cluster on which it has been placed by means which, as to one type of machine, comprises a drive plate for driving the carriers down, the plate having apertures for accepting the bottle tops, and as to another comprises a wheel having bottle-top-receiving apertures in its periphery. Complaints have been received that in handling the aforesaid prior carriers, the drive plate or wheel in certain instances broke the carriers. I believe that this has occured because the carriers were not centered with respect to the clusters, i.e., the grippers were not centered with respect to the bottles. The carrier of this invention solves the problem in that it is such as to be self-centering on a cluster, as will appear.

As shown in FIGS. 1–6, the bottle carrier 1 of this invention, which is a one-piece injection molded carrier, molded of a suitable plastic such as polypropylene, comprises the elongate handle section or portion 3 in the form of a relatively thin flat elongate plate with a downwardly extending peripheral reinforcing flange 19. The handle portion has two holes 21, one for the thumb and one for a finger, for holding it in the hand. As illustrated, the handle portion has a central portion 23 and end portions 25 narrower than the central portion, with the first row of bottle grippers 5 at one side and the second row of bottle grippers at the other side of the handle portion of plate 3. Each row, designated R, comprises three grippers, each adapted to grip a bottle B, the carrier thus being adapted to grip a cluster of six bottles (a "six-pack"). Each of the bottles has a neck 27, a finish 29 on the neck at the bottle mouth, and a bottle cap 31, the cap being illustrated a screw cap having a circular top 33, and a skirt 35 threaded on the finish with the lower end of the skirt swaged under the lower end of the finish as indicated at 37 (see FIG. 5). The bottles in the cluster are arranged in two side-by-side rows, three bottles in each row coplanar in a vertical longitudinal plane of the cluster. The two stated vertical longitudinal planes are designated X and Y (see FIG. 1). The six grippers are arranged in three pairs, one gripper of each pair on one side and the other on the other side of the handle portion in a vertical transverse plane of the carrier. The three stated transverse planes are each designated Z. The bottles in each of the rows are contiguous with respect to one another (see FIG. 5) and with respect to the bottles in the other row (see FIG. 6). The carrier is particularly adapted for a type of 16-ounce soft drink bottle which is generally about $7\frac{1}{4}$ inches tall with a body diameter of about 3 inches; thus the tops of the bottles in the cluster are generally on 3 inch centers.

The loop 7 is of generally rectangular shape, being situated below the handle portion and the grippers, and being adapted closely to surround the six bottles in the cluster for holding them in close confinement. The sides of the loop are each designated 43 and its ends are each designated 45. It has rounded corners 47. With the carrier applied to the cluster and the grippers gripping the bottle necks under the bottle finishes, the loop surrounds the bottles around the shoulders of the bottles.

Each gripper comprises a split collar 49 of generally frusto-conical shape in cross section with the top 51 of the collar as molded of an internal diameter D1 slightly less than the external diameter D2 of the neck 27 of a bottle just under the lower end of the bottle finish 29 for gripping the neck of a bottle under the bottle finish. The bottom 53 of the collar has an internal diameter D3 slightly greater than the diameter D4 of the bottle cap 31 at the top 33 of the cap. For the aforesaid 16-ounce soft drink bottles, D1 is approximately $\frac{7}{8}$ inch, and D3 is approximately $1\frac{1}{4}$ inch, the collar being about 5/32 inch high. The collars are spaced on centers corresponding to the spacing of the vertical axes of the bottles in the cluster (3" centers for the aforesaid 16–ounce bottles).

Each of the split collars is situated within a frame 55 extending laterally outwardly from the handle portion 3 of the carrier, each frame having sides 57 which extend laterally outwardly from the handle portion and a semicircular outer end 59. The collar is split at 61 toward the handle portion and the ends of the collar at the split are interconnected with the handle portion by rib members 63 which flare from said ends toward the handle portion. As illustrated, the semicircular outer end 59 of the frame has the center of its semicircle coincident with the center of the collar 49 and has a radius corresponding to the radius of the bottom 53 of the collar, and is integrally joined (in the molding of the carrier) to the bottom 53 of the collar around the lateral outer half of the bottom of the collar. The collar is also split as indicated at 64 at the midpoint of its outer half.

The loop 7 is supported in a plane parallel to the plane of the handle portion 3 and grippers 5 by a plurality of struts which extend down from the collars, each strut being integrally joined at its upper end to the bottom 53 of the respective collar and angled outward and downward therefrom to an integral juncture with the loop. As illustrated, the carrier has a first pair of such struts each designated 63X extending down from the collars 49 at the ends of the first row of collars generally in the plane X, and a second pair of such struts each designated 63Y extending down from the collars at the ends of the second row of collars generally in the plane Y. The upper ends of the struts of each of these pairs are spaced one from the other a distance D5 corresponding to and preferably slightly greater than the distance D6 measured in plane X or plane Y from the point 65 on the periphery of the top 33 of the cap of the bottle at one end of the respective row to the corresponding point 65 on the periphery of the top of the cap of the bottle at the other end of the row. With this geometry, when the carrier is placed on a cluster of bottles as illustrated in FIGS. 5–8 for being pushed down on the cluster for engagement of each split collar with the neck of a bottle under the bottle finish, the struts 63X and 63Y act to center the carrier endwise with respect to the cluster. Thus, the struts serve the dual function of supporting the loop and centering the carriers for their automated application to clusters of bottles.

In addition to the struts 63X and 63Y, the carrier has struts 67 extending down from the collars 49 at the sides of the carrier, there being three pairs of struts 67, one pair in each of the three transverse planes Z. As herein illustrated, the upper ends of the two struts 67 of each of the three pairs of struts 67 are spaced one from the other a distance D7 corresponding to and preferably slightly greater than the distance D8 measured in the respective plane Z from the point 69 on the periphery of the top of the cap of the bottle at one side of the carrier to the corresponding point 69 on the periphery of the top of the cap of the bottle at the other side of the carrier. With this geometry, the struts 67 act to center the carrier laterally with respect to the cluster C of bottles B. It is to be noted, however, that this geometry of the carrier for lateral centering may not be as important as the geometry for endwise centering, since the carriers may be generally adequately laterally centered with respect to the clusters of the bottles by being side-guided as they slide down the chutes 13 as shown in FIGS. 7 and 8, and hence it is contemplated that the carrier might be made with the upper ends of the two struts 67 of each pair of struts spaced a distance greater than D8.

Braces such as indicated at 71 are provided extending between the frames 55 adjacent the sides of the carrier.

Figure 9:
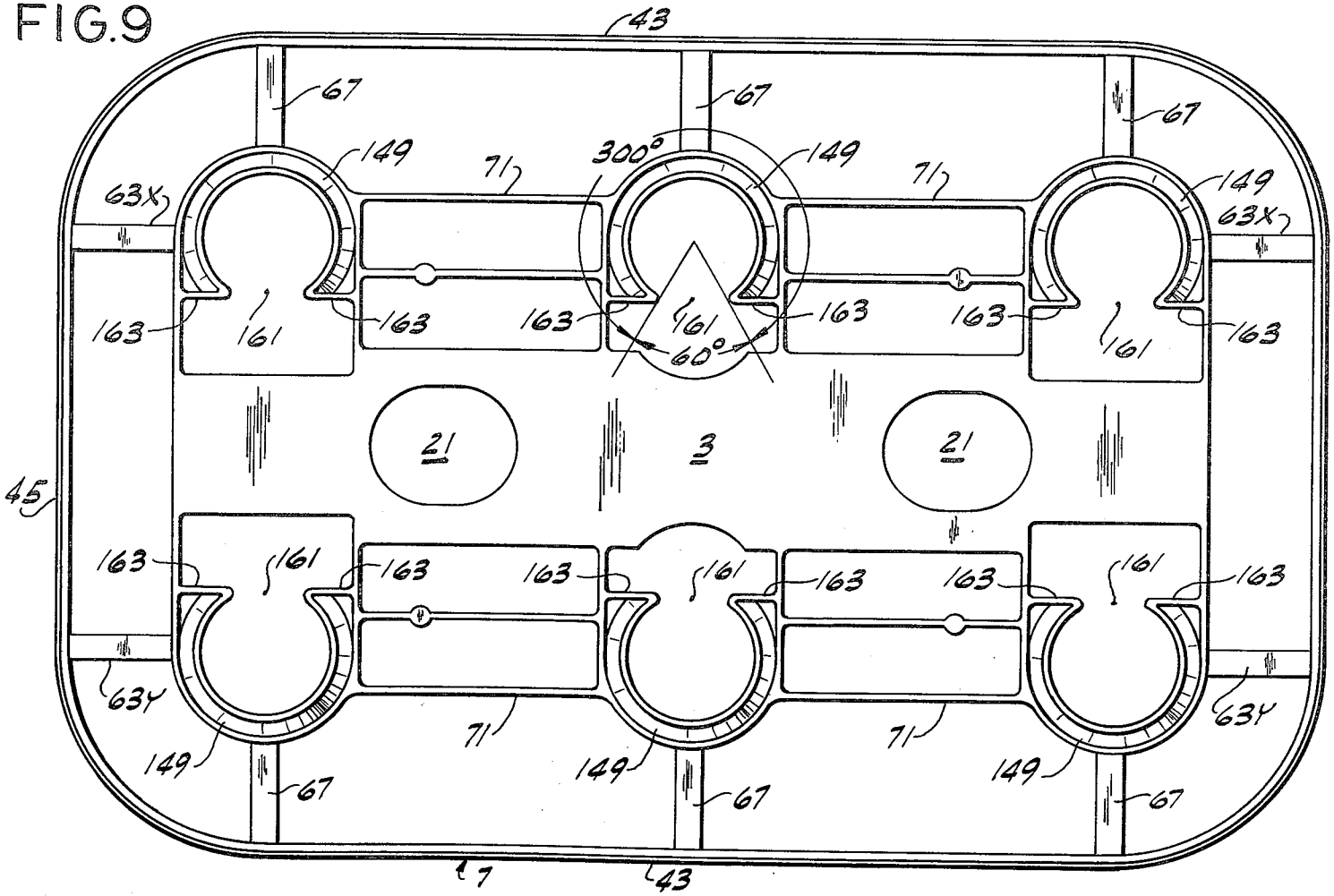
FIG. 9 is a top plan of a second embodiment.
Figure 10:
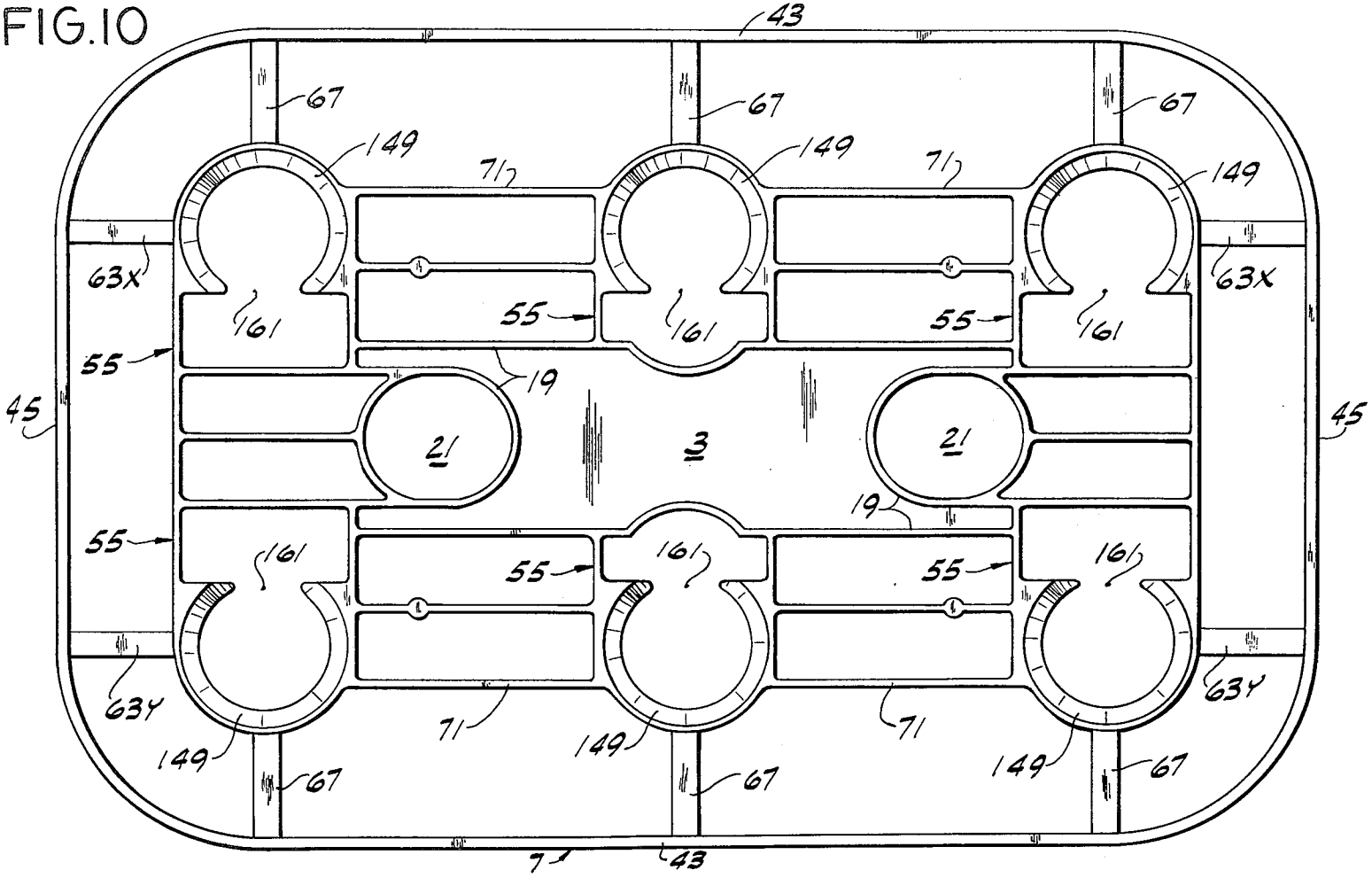
FIG. 10 is a bottom plan of the FIG. 9 embodiment.

FIGS. 9 and 10 illustrate a second embodiment of the invention which is generally similar to the above-described first embodiment, but modified to have a different type of collar designated 149, the modified collar again being of generally frusto-conical shape but with a single split or gap at 161 toward the handle portion 3, the collar extending from one of its ends to its other end about 300° (thus having a 60° gap). Reinforcing ribs 163 extend between the ends of the collar and the sides of the frames at right angles to the sides of the frames. Otherwise, the second embodiment is generally the same as the first.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A molded plastic bottle carrier for gripping a cluster of filled bottles, each of which has a neck, a finish on the neck at the bottle mouth, and a bottle cap, the bottles in the cluster being arranged in two side-by-side rows with the bottles in each row contiguous with respect to one another and with respect to the bottles in the other row, said carrier comprising:

an elongate handle portion;

a first row of bottle grippers at one side and a second row of bottle grippers at the other side of the handle portion, the grippers of the two rows being laterally aligned;

a loop of generally rectangular shape below the handle portion and the grippers, adapted to surround the bottles in the cluster for holding them in close confinement, said loop having sides and ends;

each gripper comprising a split collar for gripping the neck of a bottle under the bottle finish;

said collars being spaced on centers corresponding to the spacing of the vertical axes of the bottles in the cluster;

a first pair of loop-supporting struts, one at each end of the carrier, extending down from the collars at the ends of the first row generally in the central vertical plane of the first row;

a second pair of loop-supporting struts, one at each end of the carrier, extending down from the collars at the ends of the second row generally in the central vertical plane of the second row;

each strut being integrally joined at its upper end to the respective collar at the end of the respective row and angled outward and downward therefrom to an integral juncture with the respective end of the loop, the upper ends of the struts of each pair being spaced one from the other a distance closely corresponding to the distance measured in the central vertical plane of a row of bottles from the point on the periphery of the top of the cap of the bottle at one end of the row to the point on the periphery of the top of the cap of the bottle at the other end of the row, whereby when the carrier is placed on a cluster of bottles the struts are engageable with the bottles for guiding the carrier down to a position wherein the carrier is centered endwise with respect to the cluster for being pushed down on the cluster, without breakage of the carrier, for engagement of each split collar with the neck of a bottle under the bottle finish.

2. A molded plastic bottle carrier as set forth in claim 1 wherein each collar is of generally frusto-conical shape in cross section with the top of the collar as molded of a diameter slightly less than the external diameter of the neck of a bottle just under the lower end of the bottle finish, and with the bottom of the collar as molded of a diameter slightly greater than the diameter of the bottle cap at the top of the cap, each of said struts being integrally joined at its upper end to the bottom of the respective collar and extending downwardly from the bottom of the collar and angled outwardly.

3. A molded plastic bottle carrier as set forth in claim 1 having three grippers in each row arranged in pairs, one gripper of each pair on one side and the other on the other side of the handle portion in a vertical transverse plane of the carrier, and pairs of loop-supporting side struts extending down from the collars, one side strut of each pair being at one side and the other at the other side of the carrier, each of said side struts being integrally joined at its upper end to the respective collar at the respective side of the carrier and angled outward and downward therefrom to an integral juncture with the respective side of the loop, the upper ends of the struts of each pair of side struts being spaced one from the other a distance closely corresponding to the distance measured in the respective said vertical transverse plane from the point on the periphery of the top of the cap of the bottle at one side to the point on the periphery of the top of the bottle at the other side, whereby when the carrier is placed on a cluster of bottles for being pushed down on the cluster for engagement of each split collar with the neck of a bottle under the bottle finish, the side struts act to center the carrier laterally with respect to the cluster.

4. A molded plastic bottle carrier as set forth in claim 3 wherein each collar is of generally frusto-conical shape in cross section with the top of the collar as molded of a diameter slightly less than the external diameter of the neck of a bottle just under the lower end of the bottle finish, and with the bottom of the collar as molded of a diameter slightly greater than the diameter of the bottle cap at the top of the cap, each of said struts being integrally joined at its upper end to the bottom of the respective collar and extending downwardly from the bottom of the collar and angled outwardly.

5. A molded plastic bottle carrier as set forth in claim 1 wherein each collar is of generally frusto-conical shape in cross section with the top of the collar as molded of a diameter slightly less than the external diameter of the neck of a bottle just under the lower end of the bottle finish, and with the bottom of the collar as molded of a diameter slightly greater than the diameter of the bottle cap at the top of the cap, said carrier having a plurality of frames, one for each collar, each frame extending laterally outwardly from said handle portion at the respective side thereof and surrounding the respective collar, the collar being spaced from and split toward the handle portion, each frame being integrally joined to the respective collar at the bottom of the collar, each strut being integrally joined at its upper end to the bottom of the respective collar and the respective frame.

6. A molded plastic carrier as set forth in claim 5 wherein each collar is of generally frusto-conical shape in cross section with the top of the collar as molded of a diameter slightly less than the external diameter of the neck of a bottle just under the lower end of the bottle finish, and with the bottom of the collar as molded of a diameter slightly greater than the diameter of the bottle cap at the top of the cap, each of said struts being integrally joined at its upper end to the bottom of the respective collar and extending downwardly from the bottom of the collar and angled outwardly.

* * * * *